US012280416B2

(12) United States Patent
Tamura

(10) Patent No.: US 12,280,416 B2
(45) Date of Patent: Apr. 22, 2025

(54) HOLLOW SHELL PART MANUFACTURING METHOD

(71) Applicant: NIPPON STEEL CORPORATION, Tokyo (JP)

(72) Inventor: Shohei Tamura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 224 days.

(21) Appl. No.: 17/923,525

(22) PCT Filed: Jun. 18, 2021

(86) PCT No.: PCT/JP2021/023260

§ 371 (c)(1),
(2) Date: Nov. 4, 2022

(87) PCT Pub. No.: WO2022/014262

PCT Pub. Date: Jan. 20, 2022

(65) Prior Publication Data

US 2023/0182191 A1 Jun. 15, 2023

(30) Foreign Application Priority Data

Jul. 14, 2020 (JP) ..... 2020-120785

(51) Int. Cl.

| | |
|---|---|
| ***B21D 22/26*** | (2006.01) |
| ***B21D 7/06*** | (2006.01) |
| ***B21D 22/02*** | (2006.01) |
| ***B21D 47/01*** | (2006.01) |
| ***B21D 51/02*** | (2006.01) |

(52) U.S. Cl.
CPC ..... *B21D 22/26* (2013.01); *B21D 51/02* (2013.01)

(58) Field of Classification Search
CPC ..... B21D 22/26; B21D 22/025; B21D 51/02; B21D 47/01; B21D 7/06
See application file for complete search history.

(56) References Cited

U.S. PATENT DOCUMENTS

2017/0232492 A1 8/2017 Isogai et al.

FOREIGN PATENT DOCUMENTS

| | | | |
|---|---|---|---|
| EP | 1 864 725 A1 | | 12/2007 |
| JP | 49-40272 A | | 4/1974 |
| JP | 54-10265 A | | 1/1979 |
| JP | H07178470 A | * | 7/1995 |

(Continued)

OTHER PUBLICATIONS

English translate (WO2006106622A1), retrieved date Aug. 8, 2024.*

(Continued)

*Primary Examiner* — Mohammed S. Alawadi
(74) *Attorney, Agent, or Firm* — Birch, Stewart, Kolasch & Birch, LLP

(57) ABSTRACT

Disclosed is a manufacturing method that can suppress the occurrence of wrinkles and buckling deformation due to bending when bending and cross-sectioning are performed on a tube using a press die. The manufacturing method of the present disclosure includes applying pressure to a bent tube having a curved portion from the outside of the tube to the inside of the tube using a press die, thereby simultaneously performing cross-sectioning of the curved portion and bending of the curved portion to reduce the bend radius of the curved portion.

7 Claims, 10 Drawing Sheets

(56) References Cited

FOREIGN PATENT DOCUMENTS

| | | | | | |
|---|---|---|---|---|---|
| JP | S5410265 | A | * | 1/1997 | |
| JP | 6519984 | B2 | | 5/2019 | |
| JP | 2019181479 | A | * | 10/2019 | |
| WO | WO-2006106622 | A1 | * | 10/2006 | ..... B21D 22/025 |
| WO | WO2016/052644 | A1 | | 4/2016 | |

OTHER PUBLICATIONS

English translate (JPS5410265A), retrieved date Aug. 8, 2024.*
English translate (JP2019181479A), retrieved date Aug. 8, 2024.*
English translate (JPH07178470A), retrieved date Aug. 8, 2024.*

* cited by examiner 20
10
30
20
30
20
30
20
30
20
100
30

HOLLOW SHELL PART MANUFACTURING METHOD

FIELD

The present application discloses a manufacturing method for a hollow shell part.

BACKGROUND

PTL 1 discloses a technique for bending and cross-sectioning (processing that transforms the shape of the cross-section which intersects the longitudinal direction of the tube) a straight tube using a press die. In the technique disclosed in PTL 1, high shape accuracy is ensured for a hollow shell part after processing by simultaneously performing cross-sectioning and bending on a straight tube. According to the technique disclosed in PTL 1, a hollow shell part can be obtained only by pressing from the outside of a tube without requiring complex processes such as hydroforming, thereby improving the productivity of the hollow shell part.

CITATION LIST

Patent Literature

[PTL 1] Japanese Patent Publication No. 6519984

SUMMARY

Technical Problem

According to a new finding of the present inventor, when attempting to obtain a hollow shell part having a curved portion by simultaneously performing cross-sectioning and bending on a straight tube as disclosed in PTL 1, unsatisfactory forming such as wrinkles and buckling is easily generated on the surface of the curved portion especially when the bend radius of the curved portion is small.

Solution to Problem

As means for solving the above problem, the present application discloses

- a manufacturing method for a hollow shell part, the method comprising
- applying pressure to a bent tube having a curved portion from outside of the tube toward inside of the tube using a press die, thereby simultaneously performing cross-sectioning of the curved portion and bending of the curved portion to reduce the bend radius of the curved portion.

In the manufacturing method of the present disclosure,

- the press die may have an upper die and a lower die,
- the upper die and the lower die may respectively have press surfaces, and
- the cross-sectioning and the bending may be simultaneously performed by pressing the bent tube with the upper die and the lower die from above and below and pressing the press surfaces against the curved portion of the bent tube.

The manufacturing method of the present disclosure may comprise obtaining the bent tube having the curved portion by at least bending an original tube.

The manufacturing method of the present disclosure may comprise obtaining the bent tube having the curved portion by at least bending and cross-sectioning an original tube.

In the manufacturing method of the present disclosure, the bending performed on the original tube may comprise applying pressure from the outside of the tube toward the inside of the tube using a press die to obtain the bent tube.

In the manufacturing method of the present disclosure, the bending and the cross-sectioning performed on the original tube may comprise applying pressure from the outside of the tube toward the inside of the tube using a press die to obtain the bent tube.

In the manufacturing method of the present disclosure, the original tube may be a straight tube.

In the manufacturing method of the present disclosure, upon completion of the cross-sectioning and bending, in a cross-section orthogonal to the longitudinal direction of the hollow shell part, an inner surface of the press die may be inclined relative to an outer surface of the hollow shell part, whereby a gap may be created between the outer surface of the hollow shell part and the inner surface of the press die.

Advantageous Effects

In the manufacturing method of the present disclosure, a hollow shell part is obtained by pressing a bent tube having a curved portion so as to reduce the bend radius of the curved portion while performing cross-sectioning on the curved portion. This makes it possible to suppress unsatisfactory forming in the curved portion than when obtaining a hollow shell part having a curved portion by pressing a straight tube in one step.

BRIEF DESCRIPTION OF DRAWINGS

FIG. 3A schematically illustrates the cross-sectional shape taken along arrow IIIA-IIIA of FIG. 1; FIG. 3B schematically illustrates the cross-sectional shape taken along arrow IIIB-IIIB of FIG. 1; FIG. 3C schematically illustrates the cross-sectional shape taken along arrow IIIC-IIIC of FIG. 1; FIG. 3D schematically illustrates the cross-sectional shape taken along arrow IIID-IIID of FIG. 2;

FIG. 3E schematically illustrates the cross-sectional shape taken along arrow IIIE-IIIE of FIG. 2; and FIG. 3F schematically illustrates the cross-sectional shape taken along arrow IIIF-IIIF of FIG. 2.

FIG. 4A is a state before the bent tube 10 abuts dies 20, 30; FIG. 4B is a state immediately after the bent tube 10 abuts the dies 20, 30; and FIG. 4C is a state after pressing is completed.

FIG. 5A illustrates the cross-sectional shape taken along arrow VA-VA of FIG. 4B; FIG. 5B illustrates the cross-sectional shape taken along arrow VB-VB of FIG. 4B; FIG. 5C illustrates the cross-sectional shape taken along arrow VC-VC of FIG. 4B; FIG. 5D illustrates the cross-sectional shape taken along arrow VD-VD of FIG. 4C, FIG. 5E illustrates the cross-sectional shape taken along arrow VE-VE of FIG. 4C; and FIG. 5F illustrates the cross-sectional shape taken along arrow VF-VF of FIG. 4C.

FIG. 8A illustrates the longitudinal shape, and FIG. 8B illustrates the cross-sectional shape taken along arrow VIIIB-VIIIB of FIG. 8A.

DESCRIPTION OF EMBODIMENTS

As illustrated in FIGS. 1 to 7, the manufacturing method for a hollow shell part 100 includes applying pressure to a bent tube 10 having a curved portion 10*a* from the outside of the tube toward the inside of the tube using a press die 20, 30, thereby simultaneously performing cross-sectioning of the curved portion 10*a* and bending of the curved portion 10*a* to reduce the bend radius of the curved portion 10*a*.

1. Bent Tube 1.1 Longitudinal Shape of the Bent Tube

Figure 1:
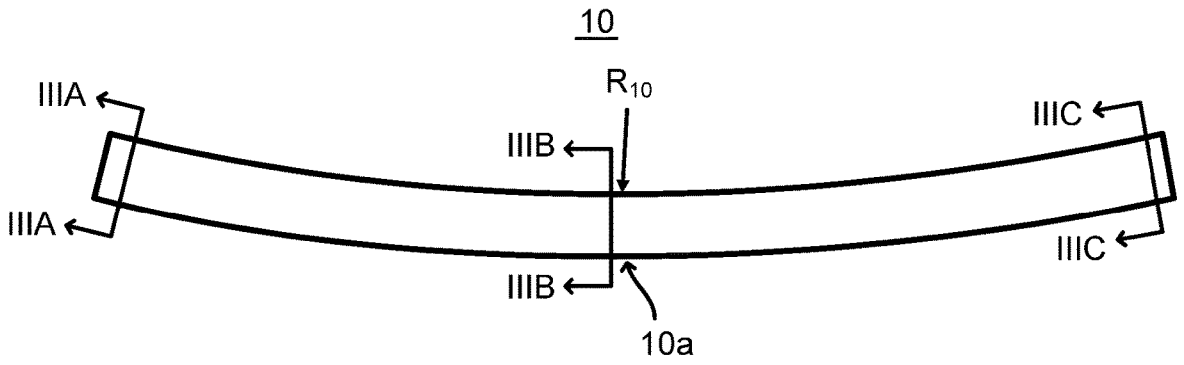
FIG. 1 is a schematic diagram to describe an example of the longitudinal shape of a bent tube 10.

As illustrated in FIG. 1, the bent tube 10 has a curved portion 10*a* at least partially. The "curved portion" refers to a bent portion in the longitudinal shape of the tube. In the present application, the "bent tube" may have a shape that satisfies, for example, the relationship of $R \leq 250D$ wherein R is the bend radius and D is the tube diameter at the curved portion. The bent tube 10 may be curved in two dimensions or in three dimensions at the curved portion 10*a*. Although FIG. 1 illustrates a mode in which the bent tube 10 is curved in the up-down direction of the paper at the curved portion 10*a*, the bent tube 10 may further be curved in the direction out of the paper (depth direction) at the curved portion 10*a*. The bent shape at the curved portion 10*a* is not particularly limited. For example, the bent tube 10 may be arched at the curved portion 10*a*. Note that it is preferable that the bent tube 10 has substantially no discontinuous surface such as wrinkles or buckling at the curved portion 10*a*.

The bend radius $R_{10}$ (inner bend radius) at the curved portion 10*a* is not particularly limited as long as the bend radius $R_{10}$ is greater than the bend radius $R_{100}$ that is described below. The bend radius $R_{10}$ may be appropriately determined by taking into account the material, the thickness, and the aperture diameter (equivalent circle diameter) of the bent tube 10, as well as, the bend radius $R_{100}$ described later. Note that the bent shape (ridge) in the longitudinal direction at the curved portion 10*a* may be configured by only one arc or may be configured by a plurality of arcs combined. The curvature may also vary continuously or discontinuously at the curved portion 10*a* from one end in the longitudinal direction toward the other end.

Although FIG. 1 illustrates a mode in which the bent tube 10 has only one curved portion 10*a*, the bent tube 10 may have a plurality of curved portions 10*a* with the same or different bend radii $R_{10}$. When pressing that is described later is performed at each of the plurality of curved portions 10*a*, the pressing may be carried out simultaneously with a single die, or the pressing may be carried out separately with a plurality of dies.

The bent tube 10 may have a straight tube portion other than the curved portion 10*a*. The "straight tube portion" refers to a straight section that is substantially free of bends in the longitudinal shape of the tube. Alternatively, the bent tube 10 may be configured by only one or more curved portions 10*a*.

The bent tube 10 need not be completely tubular in its entirety. For example, the bent tube 10 may have a notch, a slit, a through-hole, intentional irregularities, and/or the like in a portion according to its application. These notch, slit, through-hole, irregularities, and/or the like provided in the bent tube 10 may remain in the hollow shell part 100. On the other hand, the cross-sectional shape of the curved portion 10*a* may be uninterruptedly annular from the viewpoint of further increasing the shape accuracy during pressing at the curved portion 10*a*.

The length of the bent tube 10 is not particularly limited and may be appropriately determined according to its application. However, when the length of the bent tube 10 is extremely short, it may be difficult to carry out a further bending process that is described later. In the bent tube 10, the length $L_{10}$ from one end in the longitudinal direction of the tube to the other end (the length of the line continuously connecting the centers of the aperture (the centers of the figures)) may be longer than the aperture diameter (the circle equivalent diameter) $D_{10}$.

1.2 Cross-Sectional Shape of Bent Tube

Figure 3A:
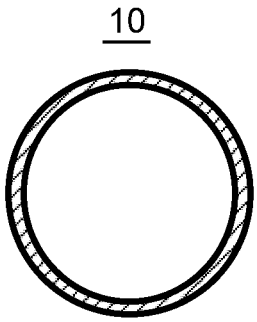
FIGS. 3A to 3F are schematic diagrams to describe examples of the cross-sectional shape of the bent tube 10 and the cross-sectional shape of the hollow shell part 100.
Figure 3B:
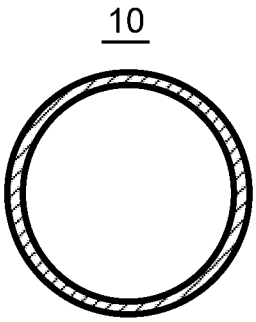
Figure 3C:
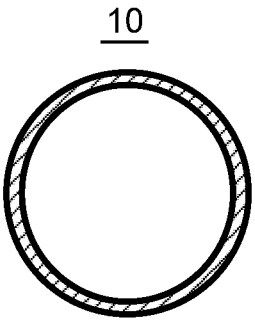

The cross-sectional shape (aperture shape) of the bent tube 10 is not particularly limited. FIGS. 3A, 3B, and 3C illustrate the cross-sectional shape of the bent tube 10 to be circular, but the cross-sectional shape may take various shapes, such as a circular shape, an elliptical shape, a flattened circular shape, a polygonal shape, a rounded polygonal shape, and a combination of these shapes. The cross-sectional shape of the bent tube 10 may be appropriately determined in view of insertion into the press die 20, 30, or the like.

The cross-sectional shape of the bent tube 10 may be the same shape without changing from one end in the longitudinal direction of the tube toward the other end, or may continuously or discontinuously change from one end in the longitudinal direction of the tube toward the other end. Note that, when the bent tube 10 has a straight tube portion, as well as, the curved portion 10*a*, the curved portion 10*a* and the straight tube portion may have the same cross-sectional shapes as each other or may have different cross-sectional shapes. Further, when the bent tube 10 has a plurality of curved portions 10*a*, the curved portions 10*a* may have the same cross-sectional shapes as each other or may have different cross-sectional shapes.

The thickness (wall thickness) of the bent tube 10 is not particularly limited and may be appropriately determined according to its application. The thickness of the bent tube 10 may be different from portion to portion.

1.3 Material of Bent Tube

The material of the bent tube 10 may be appropriately determined according to its application as long as the material is capable of being pressed. For example, the bent tube 10 may be made of metal, such as steel, iron, aluminum, titanium, and magnesium. The manufacturing method of the present disclosure can also be applied to a high-strength steel tube made of high-strength steel having a tensile strength of 440 MPa or more, 590 MPa or more, or 780 MPa or more measured at room temperature in accordance with JIS Z 2241:2011 and a high-strength steel tube made of ultra-high-strength steel having a tensile strength of 980 MPa or more.

1.4. Method of Obtaining Bent Tube

Figure 8A:
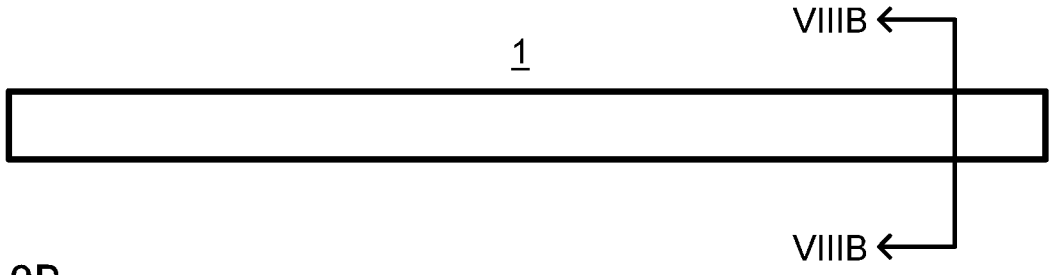
FIGS. 8A and 8B are schematic diagrams to describe an example of the shape of the original tube 1.
Figure 8B:
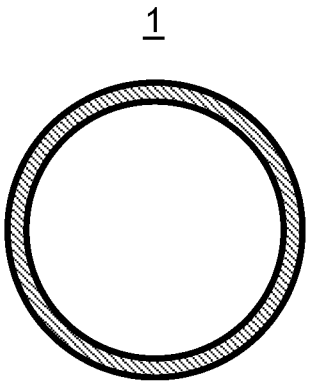

The method of obtaining a bent tube 10 is not particularly limited. For example, a bent tube 10 having a curved portion 10*a* may be obtained by at least bending an original tube (a starting material tube) 1 as illustrated in FIGS. 8A and 8B. In addition, a bent tube 10 having a curved portion 10*a* may be obtained by at least bending and cross-sectioning an original tube 1.

When obtaining a bent tube 10 from an original tube 1, the shape of the original tube 1 is not particularly limited. For example, as illustrated in FIG. 8A, the original tube 1 may be a straight tube. Alternatively, the original tube 1 may have a curved portion with a larger bend radius than the curved portion 10*a* of the bent tube 10. Alternatively, the original tube 1 may have both a curved portion and a straight tube portion. The cross-sectional shape of the original tube 1 is not particularly limited, and in addition to the circular shape illustrated in FIG. 8B, the cross-sectional shape may take various shapes, such as an elliptical shape, a flattened circular shape, a polygonal shape, a rounded polygonal shape, and a combination of these shapes. The cross-sectional shape of the original tube 1 may be the same shape without changing from one end in the longitudinal direction of the tube toward the other end or may continuously or discontinuously change from one end in the longitudinal direction of the tube toward the other end.

The method of bending the original tube 1 is not particularly limited. For example, the bent tube 10 may be obtained by pressing the original tube 1 from the outside of the tube. In other words, the bending performed on the original tube 1 may include applying pressure from the outside of the tube toward the inside of the tube using a press die to obtain the bent tube 10. In addition, cross-sectioning may be performed using a press die on the original tube 1. In other words, the bending and cross-sectioning performed on the original tube 1 may include applying pressure from the outside of the tube toward the inside of the tube using a press die to obtain the bent tube 10. In either case, a press die (first die) for obtaining the bent tube 10 from the original tube 1 and press die 20, 30 (second die) for obtaining the hollow shell part 100 from the bent tube 10 that is described later may be used separately. Specifically, the first die may have a press surface of a larger bend radius for forming a curved portion than the second die. In this manner, simply replacing the die, the pressing to transform from the original tube 1 to the bent tube 10 and the pressing to transform from the bent tube 10 to the hollow shell part 100 can also be carried out using the same press machine. In other words, the manufacturing equipment for the bent tube 10 and the manufacturing equipment for the hollow shell part 100 can be commonized to improve productivity.

Further, the bending and cross-sectioning may be simultaneously performed on the original tube 1 by applying pressure from the outside of the tube toward the inside of the tube using a press die to obtain the bent tube 10. This further improves the shape accuracy of the bent tube 10.

In the case of obtaining the bent tube 10 by at least bending the original tube 1, the minimum bend radius ($R_{10min}$) at which no buckling or wrinkles occurs may be confirmed in advance by experiment or FEM analysis before actually bending the original tube 1. In other words, when bending the original tube 1, the occurrence of buckling and wrinkles in the bent tube 10 can be further suppressed by bending the original tube 1 so that the bend radius $R_{10}$ becomes the minimum bend radius $R_{10\ min}$ or more that has been confirmed in advance.

Note that the method of obtaining a bent tube 10 is not limited to the pressing method from the outside of the tube using the press die described above. For example, a bent tube 10 may be obtained by performing conventionally known bending, such as rotary draw bending (pipe bender), tube stretch bending, tube compression bending, intrusion bending, and tube roll bending. However, as described above, from the viewpoint of commonizing the manufacturing equipment and improving productivity, it is preferable to obtain the bent tube 10 from the original tube 1 by the pressing method from the outside of the tube using a press die.

2. Press Die

Figure 4A:
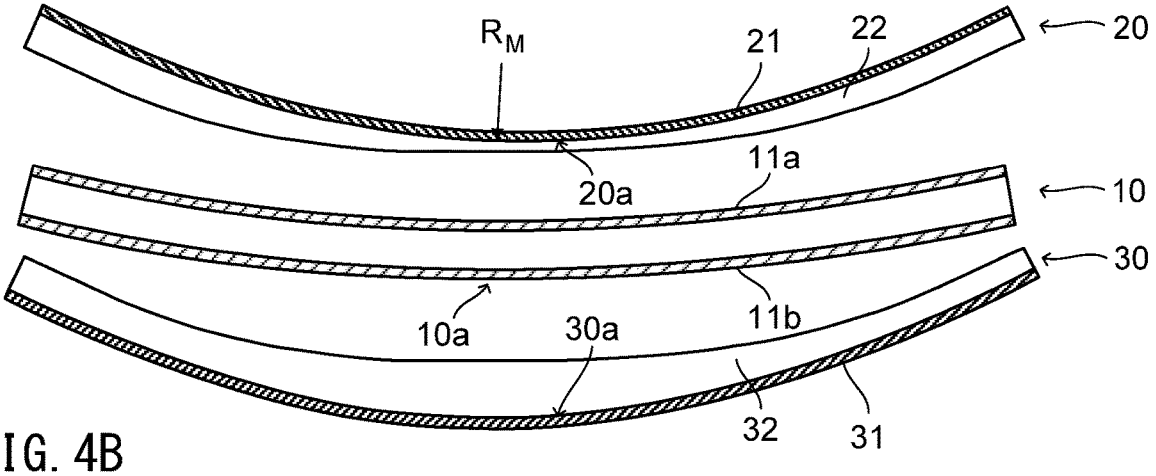
FIGS. 4A to 4C are schematic diagrams to describe an example of a process for pressing the bent tube 10 to obtain the hollow shell part 100. The cross-sectional shape along the longitudinal direction of the tube is illustrated.
Figure 4B:
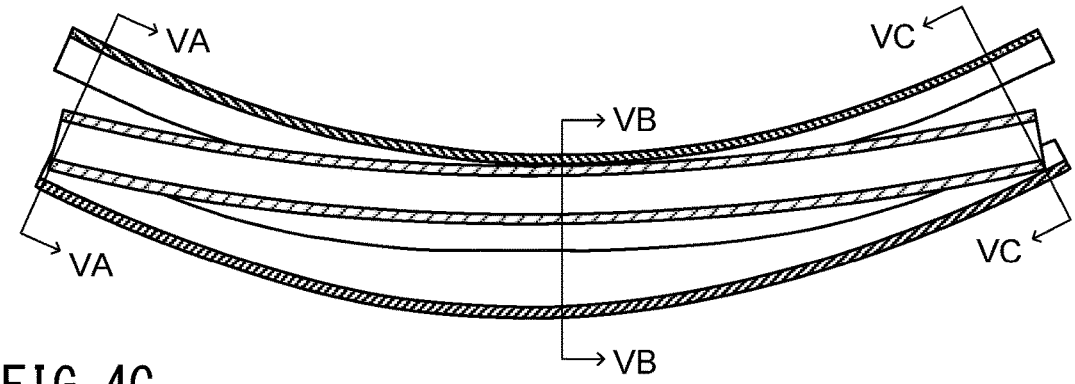
Figure 4C:
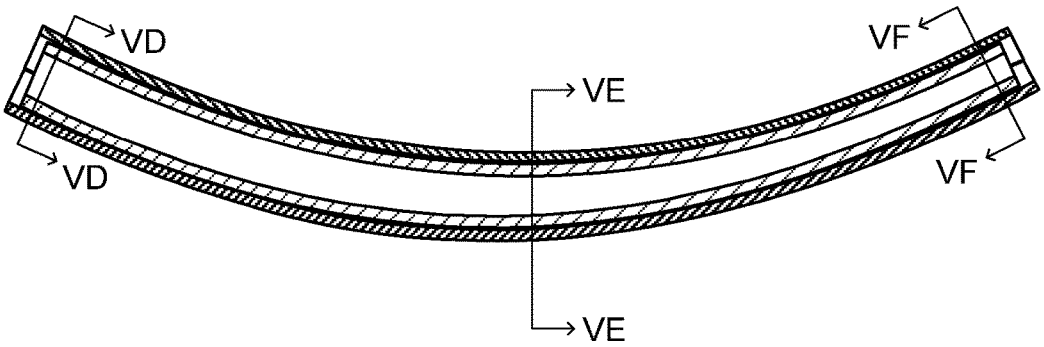
Figure 5A:
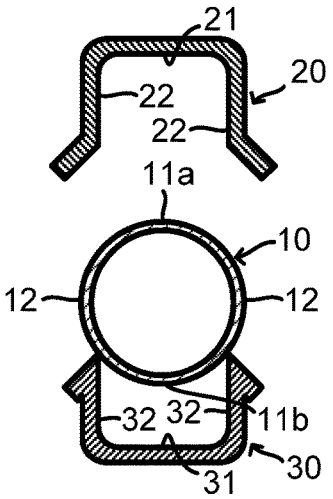
FIGS. 5A to 5F are schematic diagrams to describe an example of a process for pressing the bent tube 10 to obtain the hollow shell part 100.
Figure 5B:
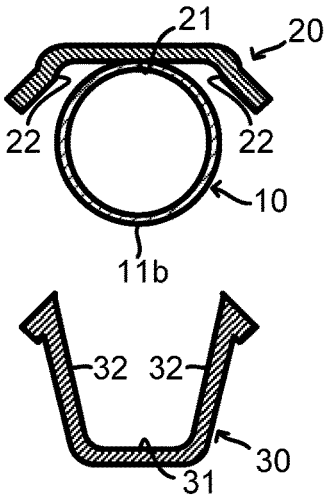
Figure 5C:
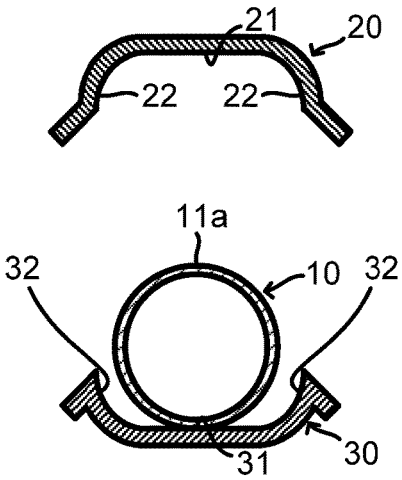
Figure 5D:
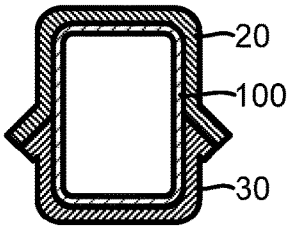
Figure 5E:
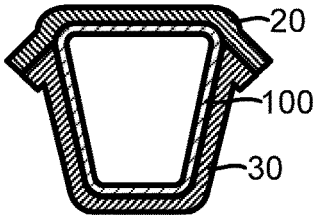
Figure 5F:
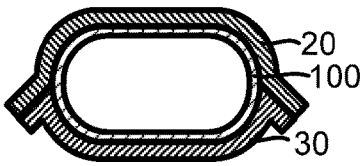

The press die may be any die as long as the press die is capable of simultaneously performing cross-sectioning of the curved portion 10*a* and bending of the curved portion 10*a* to reduce the bend radius. The material of the press die is not particularly limited, and a general material for a die can be used. The press die may be configured by a plurality of dies, in which case, by moving the plurality of dies relative to each other, pressure can be applied from the outside of the bent tube 10 towards the inside of the tube. For example, as illustrated in FIG. 4A, the press die may have an upper die 20 and a lower die 30. In this case, the upper die 20 and the lower die 30 may respectively have press surfaces 20*a*, 30*a*. As illustrated in FIGS. 4B and 4C, cross-sectioning and bending can be performed simultaneously by pressing the bent tube 10 from above and below using the upper die 20 and the lower die 30 and pressing the press surfaces 20*a*, 30*a* against the curved portion 10*a* of the bent tube 10.

The shape of the press die corresponds to the shape of the hollow shell part 100. As illustrated in FIGS. 4A to 4C and 5A to 5F, for example, when the press die includes an upper die 20 and a lower die 30, the upper die 20 may have a bottom 21 opposing the upper end 11*a* of the bent tube 10 and a side wall 22 opposing the side 12 of the bent tube 10; the lower die 30 may have a bottom 31 opposing the lower end 11*b* of the bent tube 10 and a side wall 32 opposing the side 12 of the bent tube 10; and as illustrated in FIGS. 5D to 5F and 6F, with the upper die 20 and the lower die 30 closed, the entire circumference (perimeter) of the hollow shell part 100 may be enclosed by the bottoms 21, 31 and the side walls 22, 32.

Figure 7:
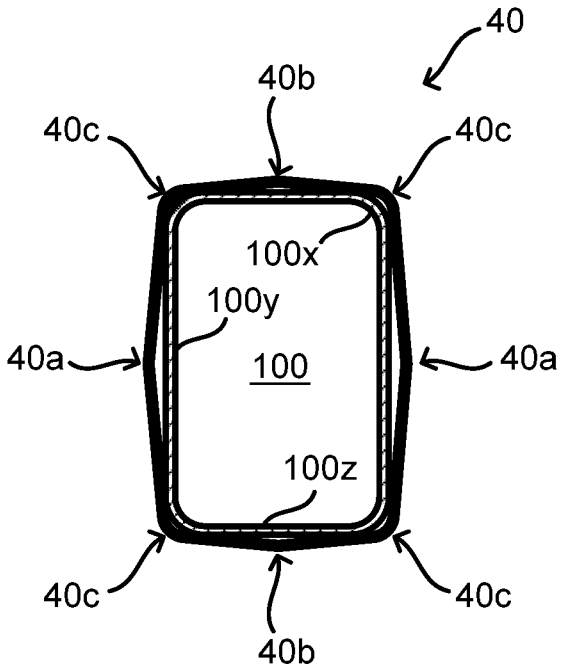
FIG. 7 is a schematic diagram to describe an example of the shapes of the press dies with an inclination.

In the manufacturing method of the present disclosure, upon completion of the cross-sectioning and bending on the bent tube 10, in a cross-section orthogonal to the longitudinal direction of the hollow shell part 100, an inner surface of the press die may be inclined relative to an outer surface of the hollow shell part 100, whereby a gap may be created between the outer surface of the hollow shell part 100 and the inner surface of the press die. For example, in a cross-section orthogonal to the longitudinal direction of the hollow shell part 100, a portion of the inner wall of the press die may have a portion that is convex outward relative to the outer wall of the hollow shell part 100. Let us consider a case where the entire circumference of the hollow shell part 100 is enclosed by the inner wall of the press die 40 upon completion of cross-sectioning and bending by the press die 40 as illustrated in FIG. 7. In this case, as illustrated in FIG. 7, in a cross-section orthogonal to the longitudinal direction of the hollow shell part 100, the hollow shell part 100 may have: a corner portion 100*x* of a small curvature radius; and a side 100*y* and a bottom 100*z* of large curvature radii, and the inner wall of the press die 40 may have: a portion 40*a* that is convex outward relative to the outer wall of the side 100*y* of the hollow shell part 100; a portion 40*b* that is convex outward relative to the outer wall of the bottom 100*z* of the hollow shell part 100; and a portion 40*c* that is convex outward relative to the outer wall of the corner portion 100*x* of the hollow shell part 100. At the portions 40*a* to 40*c* illustrated in FIG. 7, in a cross-section orthogonal to the longitudinal direction of the hollow shell part 100, the inner surface of the press die is inclined relative to the outer surface of the hollow shell part 100, whereby a gap is created between the outer surface of the hollow shell part 100 and the inner surface of the press die. In this manner, the surface of the hollow shell part 100 can be suppressed from recessing inward by inclining the inner surface of the press die relative to the outer surface of the hollow shell part 100 to create a gap between the outer surface of the hollow shell part 100 and the inner surface of the press die, in a cross-section orthogonal to the longitudinal direction of the hollow shell part 100.

In the manufacturing method of the present disclosure, as is described later, a hollow shell part 100 having a curved portion 100*a* is obtained by pressing with a press die so as to perform bending that reduces the bend radius $R_{10}$ of a curved portion 10*a* of a bent tube 10. The bend radius $R_M$ of the press surface of the press die (see FIG. 4A) may be less than the bend radius $R_{100}$ of the curved portion 100*a* of the hollow shell part 100.

When the bent tube 10 has a curved portion 10*a* that is convex downward as illustrated in FIGS. 4B and 5A to 5C, at least two locations of one and the other longitudinal ends of the curved portion 10*a* of the bent tube 10 may be abutted against the lower die 30 and at least one location other than the one and other longitudinal ends of the curved portion 10*a* of the bent tube 10 may be abutted against the upper die 20, immediately after the curved portion 10*a* is abutted against the upper die 20 and the lower die 30. In this manner, at least three locations of the bent tube 10 are abutted against the press die immediately after the press die is abutted against the bent tube 10, thereby suppressing the misalignment of the bent tube 10 relative to the press die during pressing.

Note that FIGS. 4A to 4C illustrate a pressing mode in which the curved portion 10*a* of the bent tube 10 and the curved portion 100*a* of the hollow shell part 100 are convex downward, but pressing may be performed so that the curved portion 10*a* of the bent tube 10 and the curved portion 100*a* of the hollow shell part 100 are convex upward. However, workability of pressing is considered to be superior when the tube is convex downward because the bent tube 10 can be easily placed and positioned on the lower die 30. Furthermore, the pressing direction of the press die is not limited to the up-down direction as illustrated in FIGS. 4A to 4C and may be, for example, a horizontal direction. However, when considering workability, productivity, and the like, the pressing direction by the press die may be set as the up-down direction. A known press machine may be used as a press machine in which the press die is installed.

3. Cross-Sectioning

In the manufacturing method of the present disclosure, cross-sectioning is performed that changes the cross-sectional shape of the curved portion 10*a* of the bent tube 10 by applying pressure from the outside of the tube toward the inside of the tube using the press die 20, 30. In other words, pressing the press surface 20*a*, 30*a* of the press die 20, 30 against the curved portion 10*a* from the outside the curved portion 10*a* creates a material flow in the circumferential direction (peripheral direction) of the tube at the curved portion 10*a* and changes the cross-sectional shape of the curved portion 10*a*. For example, as illustrated in FIGS. 5A to 5F, the cross-sectional shape of the curved portion 10*a* may be transformed from a first shape (for example, a circular shape) to a second shape (for example, an elliptical shape, a polygonal shape, a rounded polygonal shape, or a combination of these shapes) by cross-sectioning.

Pressure is applied from the outside of the tube toward the inside of the tube during cross-sectioning. In other words, in the manufacturing method of the present disclosure, pressure from the inside of the tube toward the outside of the tube such as by hydroforming is not applied, and the cross-sectional shape of the curved portion 10*a* of the bent tube 10 is transformed only by pressing from the outside of the tube. Note that a core die or the like may be installed inside of the tube, for example, at the tube ends or the like for cross-sectioning. This can further suppress dents, crushing, and/or the like at the tube ends and/or the like.

In the manufacturing method of the present disclosure, upon completion of cross-sectioning, a gap may or may not be created between the outer wall of the hollow shell part 100 and the press die in a cross-section orthogonal to the longitudinal direction of the hollow shell part 100.

Note that, in the manufacturing method of the present disclosure, cross-sectioning on a portion other than the portion that undergoes bending to be the curved portion 100*a* is optional. When obtaining a hollow shell part 100 having a straight tube portion, as well as, the curved portion 100*a*, cross-sectioning may or may not be performed on the straight tube portion. When cross-sectioning is performed on the straight tube portion, different cross-sectioning may be performed between the curved portion 10*a* and the straight tube portion. Furthermore, when the bent tube 10 has a plurality of curved portions 10*a*, the same cross-sectioning or different cross-sectioning may be performed between one curved portion 10*a* and the other curved portion 10*a*.

4. Bending

Figure 2:
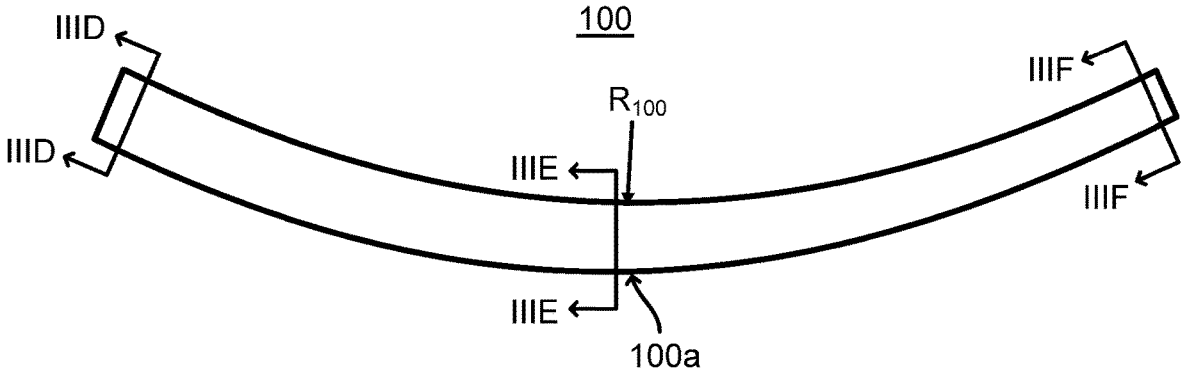
FIG. 2 is a schematic diagram to describe an example of the longitudinal shape of a hollow shell part 100.

In the manufacturing method of the present disclosure, pressing involves bending that reduces the bend radius $R_{10}$ of the curved portion 10*a* of the bent tube 10. In other words, pressing the press surfaces 20*a*, 30*a* of the press dies 20, 30 against the curved portion 10*a* from the outside of the tube creates a material flow in the longitudinal direction of the tube at the curved portion 10*a* and reduces the bend radius $R_{10}$ of the curved portion 10*a*. For example, as illustrated in FIGS. 1 and 2, bending transforms the curved portion 10*a* of a bend radius $R_{10}$ to the curved portion 100*a* of a bend radius $R_{100}$.

Pressure is applied from the outside of the tube toward the inside of the tube during bending. In other words, in the manufacturing method of the present disclosure, pressure from the inside of the tube toward the outside of the tube such as by hydroforming is not applied, and the bend radius of the curved portion 10*a* of the bent tube 10 is reduced only by pressing from the outside of the tube.

In the manufacturing method of the present disclosure, upon completion of bending, a gap may or may not be created between the outer wall of the hollow shell part 100 and the press die in a longitudinal direction of the hollow shell part 100.

Note that, in the manufacturing method of the present disclosure, bending on a portion other than the curved portion 10*a* is optional. For example, when the bent tube 10 has a straight tube portion, gentle bending may be applied to the straight tube portion to the extent that no wrinkles or buckling occurs.

Figures 6A, 6B, 6C, 6D, 6E, 6F:
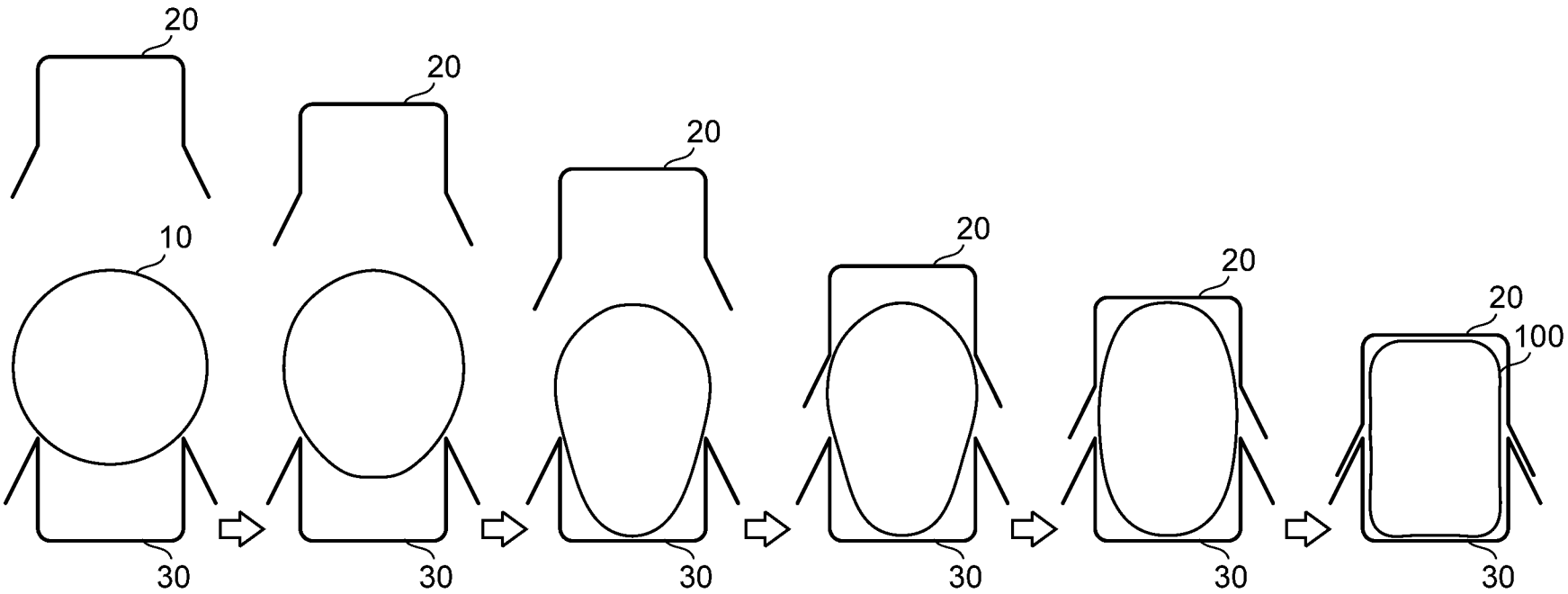
FIGS. 6A to 6F are schematic diagrams to describe an example of a flow form in the circumferential direction of a tube relative to press dies during pressing.

In the manufacturing method of the present disclosure, the above-described bending is performed simultaneously with the above-described cross-sectioning. In other words, during pressing, the material flow in the circumferential direction (peripheral direction) of the tube and the material flow in the longitudinal direction of the tube simultaneously proceed at the curved portion 10*a* of the bent tube 10, thereby ensuring high shape accuracy of the hollow shell part 100. The cross-sectioning and bending of the tube using the press die are performed, for example, according to a flow as illustrated in FIGS. 6A to 6F. The mode illustrated in FIGS. 6A to 6F corresponds to the mode illustrated in FIGS. 5A and 5D and illustrates a case of transforming a circular tube cross-section to a rounded rectangular cross-section. As illustrated in FIGS. 6A to 6F, the tube can be brought into contact with at least one of the upper die 20 and the lower die 30 (FIG. 6A), the upper die 20 and the lower die 30 can be brought closer to each other and a portion of the tube is inserted inside the upper die 20 and the lower die 30 while flowing, the forming proceeds without biting the tube in the gap between the upper die 20 and the lower die 30 (FIGS. 6B to 6E), and the cross-sectioning and bending of the tube can be completed by closing the upper die 20 and the lower die 30 (FIG. 6F). Note that in the manufacturing method of the present disclosure, as long as the cross-sectioning and bending may proceed simultaneously at a certain point in time, the timing of the start and completion of the cross-sectioning and the timing of the start and completion of the bending need not be strictly simultaneous.

When obtaining the hollow shell part 100 by pressing the bent tube 10, the minimum bend radius $R_{100min}$ where buckling and wrinkles do not occur may be confirmed by experiment, FEM analysis, or the like before actually pressing the bent tube 10. In other words, when pressing the bent tube 10, the occurrence of buckling and wrinkles in the hollow shell part 100 can be further suppressed by bending the bent tube 10 so that the bend radius $R_{100}$ becomes the minimum bend radius $R_{100min}$ or more that has been confirmed in advance.

5. Hollow Shell Part 5.1 Longitudinal Shape of the Hollow Shell Part

As illustrated in FIG. 2, the hollow shell part 100 has a curved portion 100*a* at least partially. As described above, the hollow shell part 100 may be referred to as a "press-formed tube" because the tube has been formed through pressing. The longitudinal direction of the hollow shell part 100 may correspond to the longitudinal direction of the tube prior to pressing. The hollow shell part 100 may be curved in two dimensions or in three dimensions at the curved portion 100*a*. For example, in FIG. 2, the hollow shell part 100 is illustrated to be curved in the up-down direction of the paper at the curved portion 100*a* but may be further curved directed out of the paper at the curved portion 100*a*. The bent shape at the curved portion 100*a* is not particularly limited. For example, the hollow shell part 100 may be arched at the curved portion 100*a*. The bent shape of the hollow shell part 100 can be easily changed by changing the shapes of the press surfaces of the press die 20, 30 described above.

The bend radius $R_{100}$ (inner bend radius) at the curved portion 100*a* is not particularly limited as long as the bend radius $R_{100}$ is smaller than the above-described bend radius $R_{10}$. Note that the bent shape (ridge) in the longitudinal direction of the curved portion 100*a* may be configured by only one arc or may be configured by a plurality of arcs combined. The curvature may also vary continuously or discontinuously at the curved portion 100*a* from one end in the longitudinal direction toward the other end.

Although FIG. 2 illustrates a mode in which the hollow shell part 100 has only one curved portion 100*a*, the hollow shell part 100 may have a plurality of curved portions 100*a* with the same or different bend radii $R_{100}$.

The hollow shell part 100 may have a straight tube portion other than the curved portion 100*a*. Alternatively, the hollow shell part 100 may be configured by only one or more curved portions 100*a*.

The hollow shell part 100 need not be fully tubular in its entirety. For example, the hollow shell part 100 may have a notch or a slit in a portion. The hollow shell part 100 may also have a through-hole or intentional irregularities in a portion.

The length of the hollow shell part 100 is not particularly limited and may be appropriately determined according to its application. The length of the hollow shell part 100 may be the same as or different from the length of the bent tube 10. For example, the length of the hollow shell part 100 may be shorter than the length of the bent tube 10 by undergoing a process of enlarging the aperture diameter (circle equivalent diameter) relative to the aperture diameter of the bent tube 10 or other processes, in addition to the bending and cross-sectioning of the present disclosure. Alternatively, the length of the hollow shell part 100 may be longer than the length of the bent tube 10 by undergoing a process of thinning the tube thickness relative to the bent tube 10 or reducing the diameter of the tube or other processes.

5.2. Cross-Sectional Shape of the Hollow Shell Part

Figure 3D:
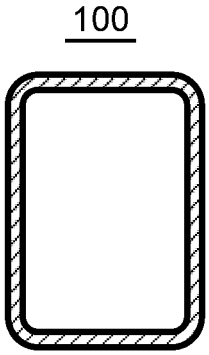
Figure 3E:
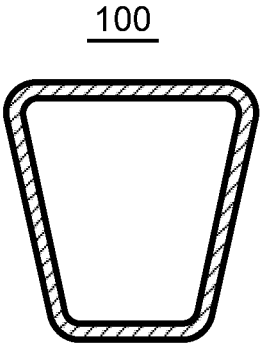
Figure 3F:
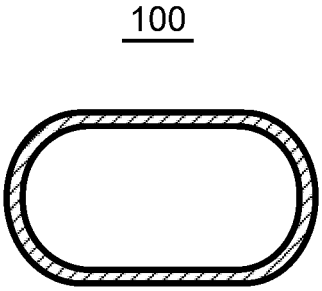

The cross-sectional shape (aperture shape) of the hollow shell part 100 is not particularly limited. FIGS. 3D, 3E, and 3F illustrate the cross-sectional shape of the hollow shell part 100 to be a polygonal shape or an elliptical shape, but the cross-sectional shape may take various shapes, such as a polygonal shape, an elliptical shape, a circular shape, a flattened circular shape, a rounded polygonal shape, and a combination of these shapes. The cross-sectional shape of the hollow shell part 100 may be appropriately determined according to its application. The cross-sectional shape of the hollow shell part 100 can be easily changed by changing the shape of the press surfaces of the press die 20, 30 described above.

The cross-sectional shape of the hollow shell part 100 may be the same shape without changing from one end in the longitudinal direction of the tube toward the other end or may continuously or discontinuously change from one end in the longitudinal direction of the tube toward the other end as illustrated in FIGS. 3D to 3F. When the hollow shell part 100 has a straight tube portion, as well as, the curved portion 100*a*, the curved portion 100*a* and the straight tube portion may have the same cross-sectional shapes as each other or may have different cross-sectional shapes. Further, when the hollow shell part 100 has a plurality of curved portions 100*a*, the curved portions 100*a* may have the same cross-sectional shapes as each other or may have different cross-sectional shapes.

The thickness (wall thickness) of the hollow shell part 100 is not particularly limited and may be appropriately determined according to its application. The thickness of the hollow shell part 100 may vary from portion to portion.

As described above, in the manufacturing method of the hollow shell part 100 of the present disclosure, a bent tube 10 having a curved portion 10*a* is pressed so as to reduce the bend radius of the curved portion 10*a* while performing cross-sectioning on the curved portion 10*a*. This makes it possible to suppress unsatisfactory forming at the curved portion 100*a* than when obtaining a hollow shell part 100 having a curved portion 100*a* by pressing a straight tube in one step.

Note that the manufacturing method of the present disclosure can also be applied, for example, to a case of manufacturing a tapered tube. In other words, a tapered tube may be obtained as the hollow shell part 100 by cross-sectioning according to the manufacturing method of the present disclosure, or a tapered tube may be used as the bent tube 10 for obtaining the hollow shell part 100.

5.3 Examples of the Application of the Hollow Shell Part

The application of the hollow shell part 100 obtained by the manufacturing method of the present disclosure is diverse. For example, the application may be in automobile parts, such as a bumper beam, a suspension member, a side rail, a trailing arm, an upper arm, a pillar, a torsion beam, a door impact beam, and an instrument panel beam.

6. Summary

Figure 9:
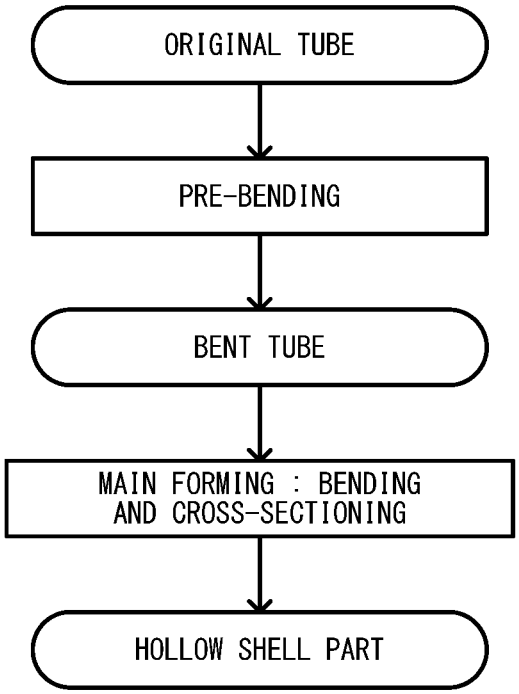
FIG. 9 is a diagram illustrating an example of a flow of a manufacturing method for a hollow shell part.

As described above, the method of the present disclosure is for manufacturing a hollow shell part 100 having a curved portion 100*a* with a small bend radius by using a press die and simultaneously performing bending and cross-sectioning on a bent tube 10 that has been bent in advance so as to change the cross-sectional shape of the curved portion 10*a* of the bent tube 10 while reducing the bend radius of the curved portion 10*a*. As described above, the method of the present disclosure may also include a process of preparing the bent tube 10 in advance as a process separate from bending and cross-sectioning using the above press die. For example, as illustrated in FIG. 9, a bent tube 10 having a curved portion 10*a* may be obtained by at least bending (pre-bending) an original tube 1 (as described above, the original tube 1 may be a straight tube). Thereafter, the obtained bent tube 10 may be arranged inside the press die from outside the press die, and subsequently, the above-described bending and cross-sectioning may be performed simultaneously to reduce the bend radius of the curved portion 10*a* while changing the cross-sectional shape of the curved portion 10*a* of the bent tube 10 (main forming), thereby obtaining a hollow shell part 100 having a predetermined curved portion 100*a*. As in the method of the present disclosure, by simultaneously performing bending and cross-sectioning using a press die on a bent tube 10 that has been bent in advance, a hollow shell part 100 having a curved portion 100*a* of a small bend radius can be manufactured while suppressing wrinkles and buckling.

EXAMPLES

Hereinafter, the effects of the manufacturing method of the hollow shell part of the present disclosure are described in more detail with Examples.

1. Comparative Example

Figure 10:
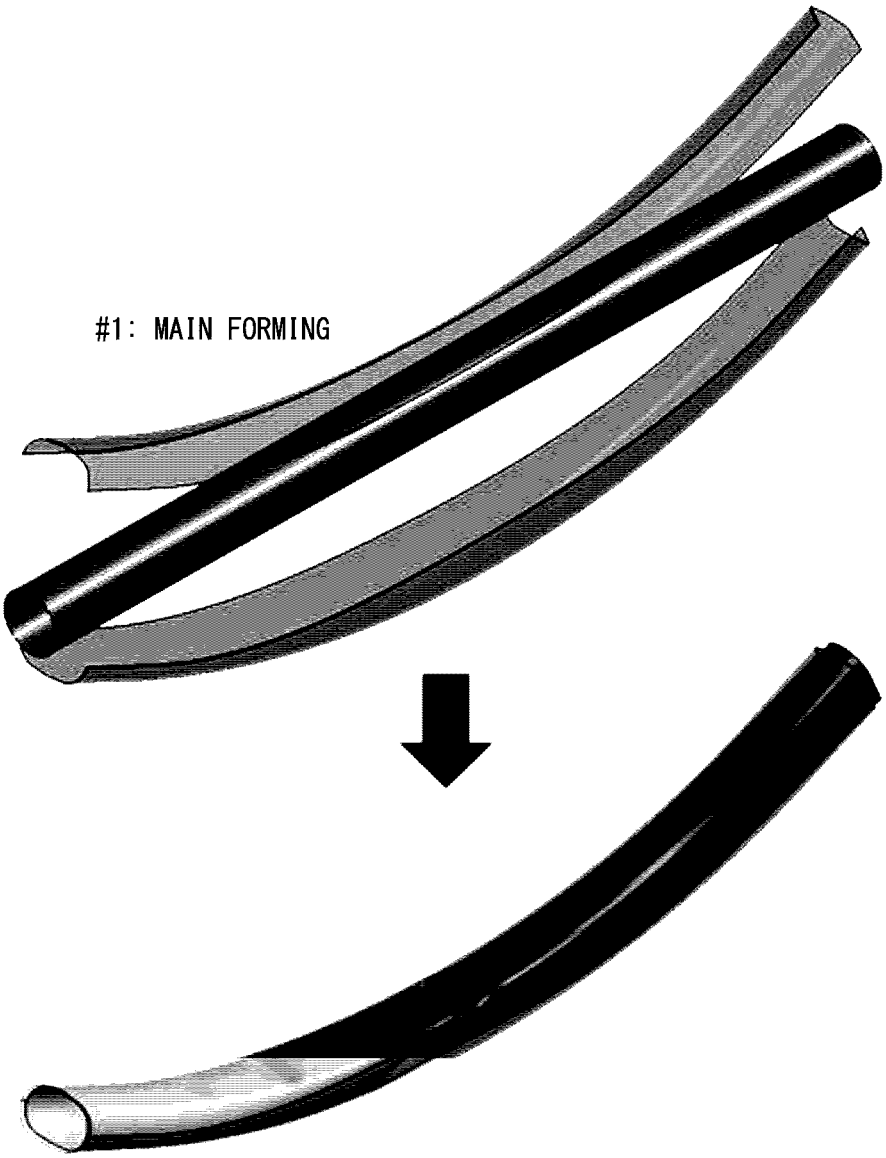
FIG. 10 is a diagram illustrating the result of FEA to describe pressing conditions according to Comparative Example.

As illustrated in FIG. 10, a hollow shell part was obtained only by main-forming in one process by simultaneously performing cross-sectioning and bending using a press die on a straight tube (980-MPa class steel tube, φ38. 1 mm, thickness 1.0 mm, length 600 mm) so as to change the cross-sectional shape of the straight tube while bending at a predetermined bend radius.

Figure 11:
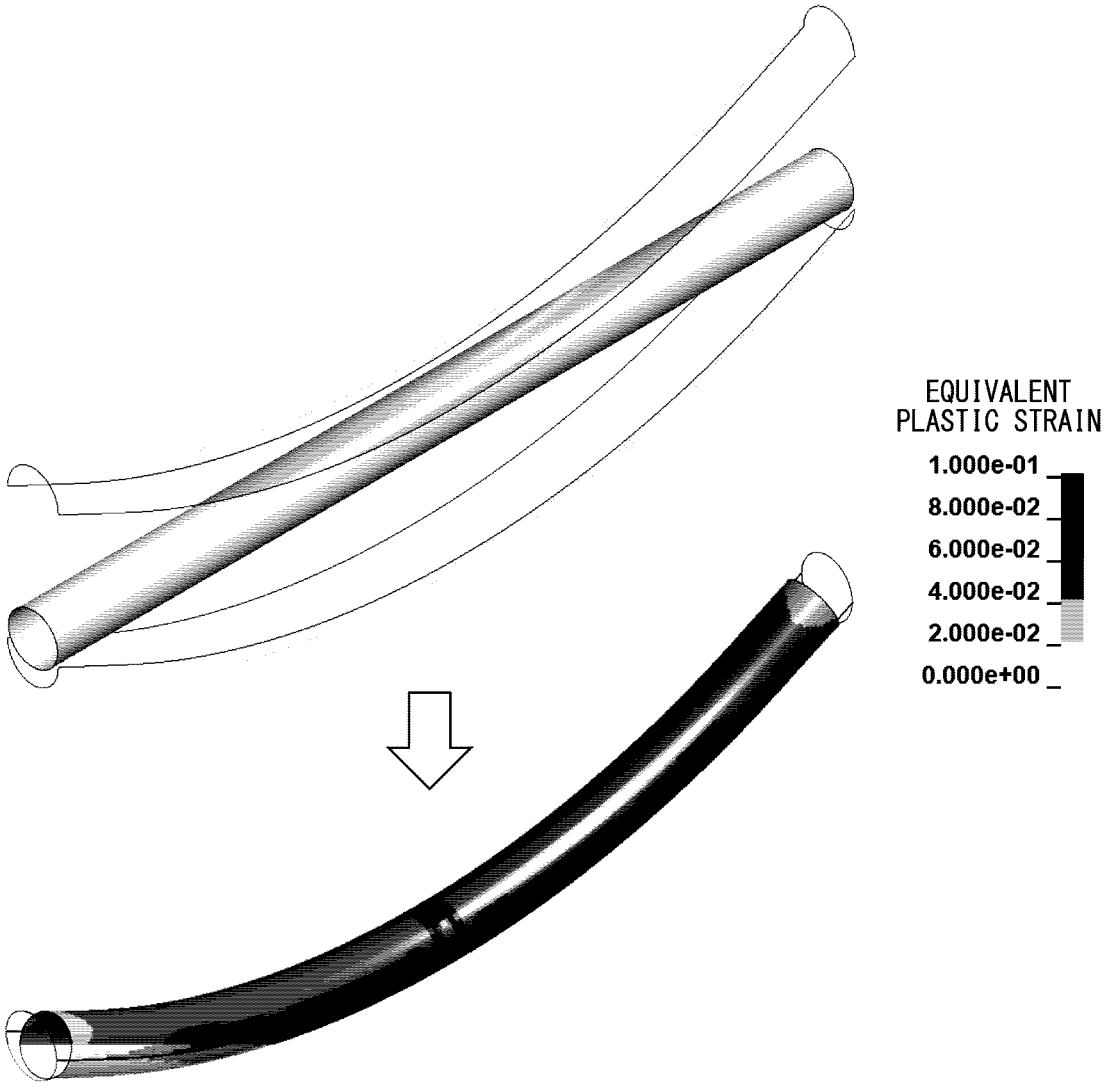
FIG. 11 is a diagram illustrating the result of FEA to illustrate an example of a hollow shell part according to Comparative Example.

As a result of the experiment, with regard to the straight tube described above, cross-sectioning and bending using a press die without generating wrinkles or buckling were possible up to a bend radius of about 700 mm. However, when the bend radius fell below 700 mm, buckling deformation was observed on the surface of the hollow shell part. For example, as is clear from the FEM analysis result illustrated in FIG. 11, when the bend radius is set to 570 mm, buckling deformation occurs in the longitudinal central portion (bending central portion) of the hollow shell part.

2. Example

Figure 12:
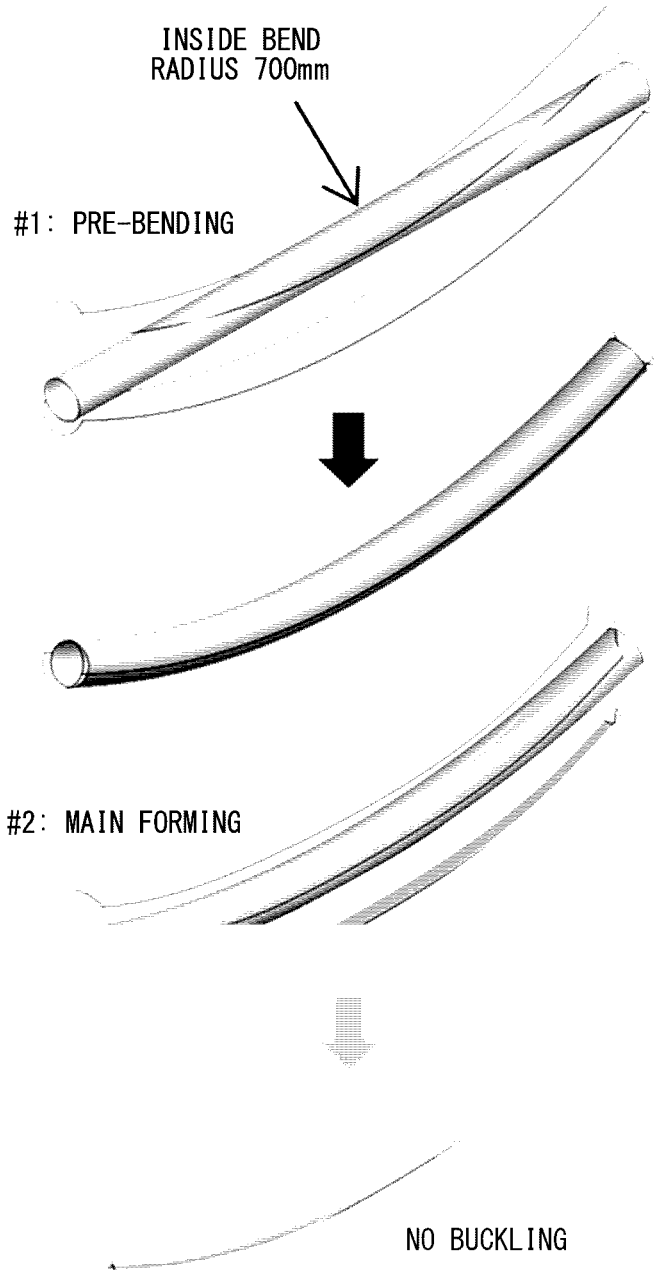
FIG. 12 is a diagram illustrating the result of FEA to describe pressing conditions according to Example.

As illustrated in FIG. 12, after obtaining a bent tube having a bend radius of 700 mm by bending (pre-bending) using a press die on a straight tube similar to Comparative Example, main-forming is performed, in which cross-sectioning and bending are simultaneously performed on the bent tube using a press die, to reduce the bend radius of the curved portion to 570 mm. No wrinkles or buckling were observed at the curved portion of the obtained hollow shell part.

According to the above results, it can be said that even when the same straight tube is used as the original, wrinkles and buckling on the final hollow shell part can be suppressed by pre-bending and pressing, rather than pressing in one step. Note that, although pre-bending is performed by pressing in the above-described mode, even when pre-bending is performed by a method other than pressing (hydroforming or the like), a hollow shell part with high shape accuracy can be obtained while suppressing wrinkles and buckling of the curved portion by subsequent pressing similar to the above-described mode.

3. Supplemental Notes

Note that, as in Comparative Example, when a hollow shell part having a small bend radius is obtained in one step by pressing a straight tube only once, the reason for unsatisfactory forming such as wrinkles and buckling at the curved portion of the hollow shell part can be considered as given below. That is, it is considered that, even when simultaneous bending and cross-sectioning are performed on a straight tube using a press die, the bend radius of the press surface of the press die is too small for the material to flow smoothly in the circumferential direction (peripheral direction) of the tube and the material dents inwardly, thus, buckling deformation occurs at the longitudinal central portion of the tube (because only bending proceeds before cross-sectioning).

In contrast, as illustrated in Example, by simultaneously performing bending and cross-sectioning on a pre-bent tube rather than a straight tube, a hollow shell part having a curved portion of a small bend radius can be manufactured while suppressing the above-described wrinkles and buckling. In other words, when wrinkles and buckling are assumed to occur due to bending at a small bend radius, performing cross-sectioning simultaneously with bending allows the tube material to flow appropriately not only in the longitudinal direction of the tube but also in the circumferential direction (peripheral direction) of the tube, which can prevent the occurrence of wrinkles and buckling.

Note that the method of the present disclosure can also be considered as, for example, dividing a bending process into obtaining a bent tube from an original tube and further bending and cross-sectioning the bent tube. It had been generally believed that dividing the cold bending process has no effect. However, according to a new finding of the present inventor and estimation based on the finding, it is conceivable that, when the bending process is divided, deformation can be dispersed in the latter process at a location separate from the location that was bent in the former process. In other words, it is conceivable that the occurrence of buckling and wrinkles in the hollow shell part that is finally obtained can be suppressed by dispersing the deformation locations during bending. Conventionally, it is not easy for even those skilled in the art to predict the effect of dividing the bending process in this manner. This is because it is common for those skilled in the art to try to reduce the number of steps as small as possible in the first place from the viewpoint of production efficiency.

REFERENCES SIGNS LIST

1 Original tube (Starting material tube)
10 Bent tube
10*a* Curved portion
11*a* Upper end
11*b* Lower end
12 Side
20 Upper die (press die)
21 Bottom
22 Side wall
30 Lower die (press die)
31 Bottom
32 Side wall
100 Hollow shell part
100*a* Curved portion

The invention claimed is:

1. A manufacturing method for a hollow shell part, the method comprising:

obtaining a bent tube having a curved portion by at least bending an original tube, wherein the curved portion has a bend radius of equal to or more than a minimum bend radius $R_{10min}$ at which no buckling or wrinkles occurs, and applying pressure to the bent tube having the curved portion from outside of the tube toward inside of the tube using a press die, thereby simultaneously performing cross-sectioning of the curved portion and bending of the curved portion to reduce the bend radius of the curved portion, wherein the bend radius of the curved portion is reduced to less than the minimum bend radius $R_{10min}$.

2. The manufacturing method according to claim 1, wherein the press die has an upper die and a lower die, the upper die and the lower die respectively have press surfaces, and the cross-sectioning and the bending are simultaneously performed by pressing the bent tube with the upper die and the lower die from above and below and pressing the press surfaces against the curved portion of the bent tube.

3. The manufacturing method according to claim 1, comprising:

obtaining the bent tube having the curved portion by at least bending and cross-sectioning the original tube.

4. The manufacturing method according to claim 3, wherein the bending and the cross-sectioning performed on the original tube comprises:

applying pressure from the outside of the tube toward the inside of the tube using a press die to obtain the bent tube.

5. The manufacturing method according to claim 1, wherein the bending performed on the original tube comprises;

applying pressure from the outside of the tube toward the inside of the tube using a press die to obtain the bent tube.

6. The manufacturing method according to claim 1, wherein the original tube is a straight tube.

7. The manufacturing method according to claim 1, wherein upon completion of the cross-sectioning and bending, in a cross-section orthogonal to a longitudinal direction of the hollow shell part, an inner surface of the press die is inclined relative to an outer surface of the hollow shell part, whereby a gap is created between the outer surface of the hollow shell part and the inner surface of the press die.

* * * * *